US006051801A

United States Patent [19]

Wang

[11] Patent Number: 6,051,801

[45] Date of Patent: Apr. 18, 2000

[54] TWO POSITION ROTARY SWITCH WITH POWER CABLE FEATURES

[76] Inventor: Lien-Sheng Wang, No.27, 8$^{th}$ Floor-2, Alley 3, Lane 318, 2$^{nd}$ Section, Chong-Sing RD., Chu-Dong, Hsinchu, Taiwan

[21] Appl. No.: 09/283,300

[22] Filed: Apr. 1, 1999

[51] Int. Cl.$^{7}$ ..... H01H 19/20; H01H 1/26; H01H 1/44

[52] U.S. Cl. ..... 200/571; 200/284

[58] Field of Search ..... 200/283, 284, 200/564–572

[56] References Cited

U.S. PATENT DOCUMENTS

| | | | |
|---|---|---|---|
| 2,470,643 | 5/1949 | Rath | 200/571 |
| 2,723,327 | 11/1955 | Gilbert | 200/570 |
| 2,777,023 | 1/1957 | Sepulveda | 200/564 X |
| 3,689,723 | 9/1972 | Ludwig | 200/284 X |
| 4,612,423 | 9/1986 | Munroe | 200/16 R |
| 4,816,623 | 3/1989 | Huang | 200/569 X |
| 5,743,387 | 4/1998 | Hung | 200/571 |
| 5,854,456 | 12/1998 | Lee-Ven | 200/569 X |

*Primary Examiner*—J. R. Scott
*Attorney, Agent, or Firm*—Rabin & Champagne, P.C.

[57] ABSTRACT

An improved switch design with power cable locking capability. A lower housing has at one end of its internal sides a receptacle for a power cord fitting in it firmly. At its other internal side, a passage is provided between two deflectors for two ends of a sheared power cord, with each cord end being bent round in order to hold them in the receptacle firmly. Blade/leaf conductors are provided which have a convex end and an elastic design so that when the upper and the lower housings are assembled together, the convex end of the blade/leaf conductors will contact with the copper switching conductor on the switching wheel. The switch design provides reliable electrical conduction, prevents breakage and electrical leakage, and provides a secure electrical connection even in the case of an applied foreign force.

8 Claims, 5 Drawing Sheets

TWO POSITION ROTARY SWITCH WITH POWER CABLE FEATURES

FIELD OF THE INVENTION

The present invention relates to an improved switch design with power cable locking, and especially, a switch design able to provide a secure and reliable electrical connection even when a foreign force is applied, and a switch design that prevents electrical leakage.

BACKGROUND OF THE INVENTION

A conventional power switch design, is shown in FIG. 1. At a proper point of a power cable 20, a section of one of its cords is cut off. Then, the power cable 20 is placed into the receptacle of the lower housing 11. A washer 16 is positioned over the lower housing 11. A switching wheel 13 with a copper switching conductor 14 and blade/leaf conductors 15 are positioned in upper housing 12. Then, the upper housing 12 is assembled onto the lower housing 11 by pressing them together so that the blade/leaf conductors 15 in the upper housing 12 cut through the outer cord insulator and contact with the inner conductive cord wire, thus providing a function of electrical conduction. Finally the assembly is fastened by a screw and a nut. Such a design has the following deficiencies: the blade/leaf conductors 15 have their end edge rested on the copper switching conductor 14 giving a 'point-to-plane' contact of an extremely small area, so that spark eruption will happen at the very moment when the switch is on. The cumulated carbon and oxide produced due to spark eruption on the leaf conductors after long term use will destroy the conductivity of the leaf conductors causing a power failure. Moreover at the sheared cord ends where the blade/leaf conductors are coupled to the cord, it is possible that the sheared cord ends will be removed by the application of a foreign force, causing the blade to be bent, increasing a risk of electrical leakage or power failure, and causing undesired troubles in use.

Therefore, the inventor developed an improved switch design which provides a secure and reliable electrical connection even in the case of an application of a foreign force.

SUMMARY OF THE INVENTION

An object of the present invention is to provide an improved switch design with power cable locking. The switch design provides a secure and reliable electric connection even in the case of an applied foreign force, thus preventing electrical leakage.

In order to describe in detail the objects, characteristics and functions of the present invention, an example of an embodiment and relative figures to the present invention are given as follows:

DETAILED DESCRIPTION OF THE INVENTION

Figure 1:
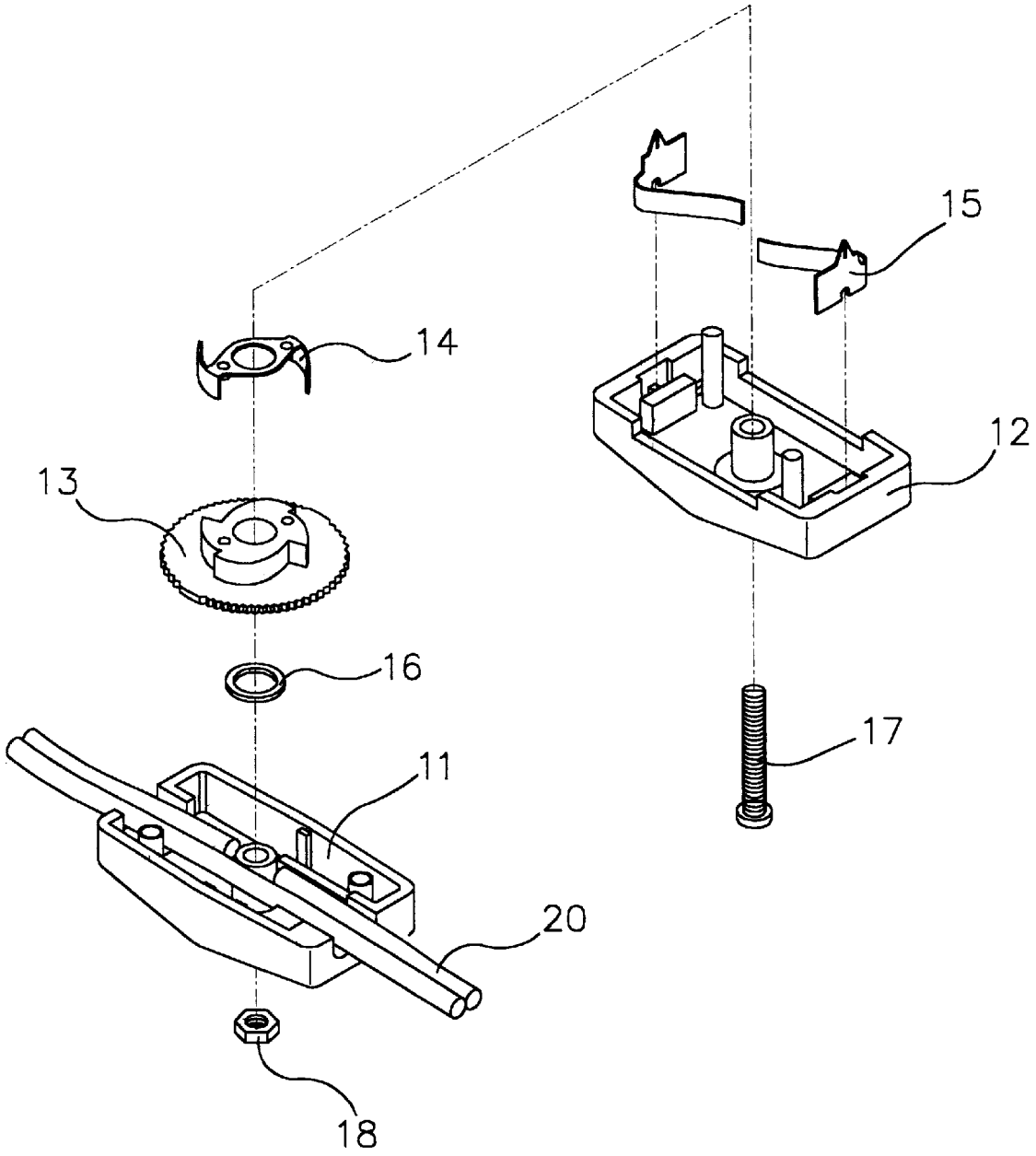
FIG. 1 PRIOR ART
FIG. 1 is a schematic exploded view of a conventional switch design.
Figure 2:
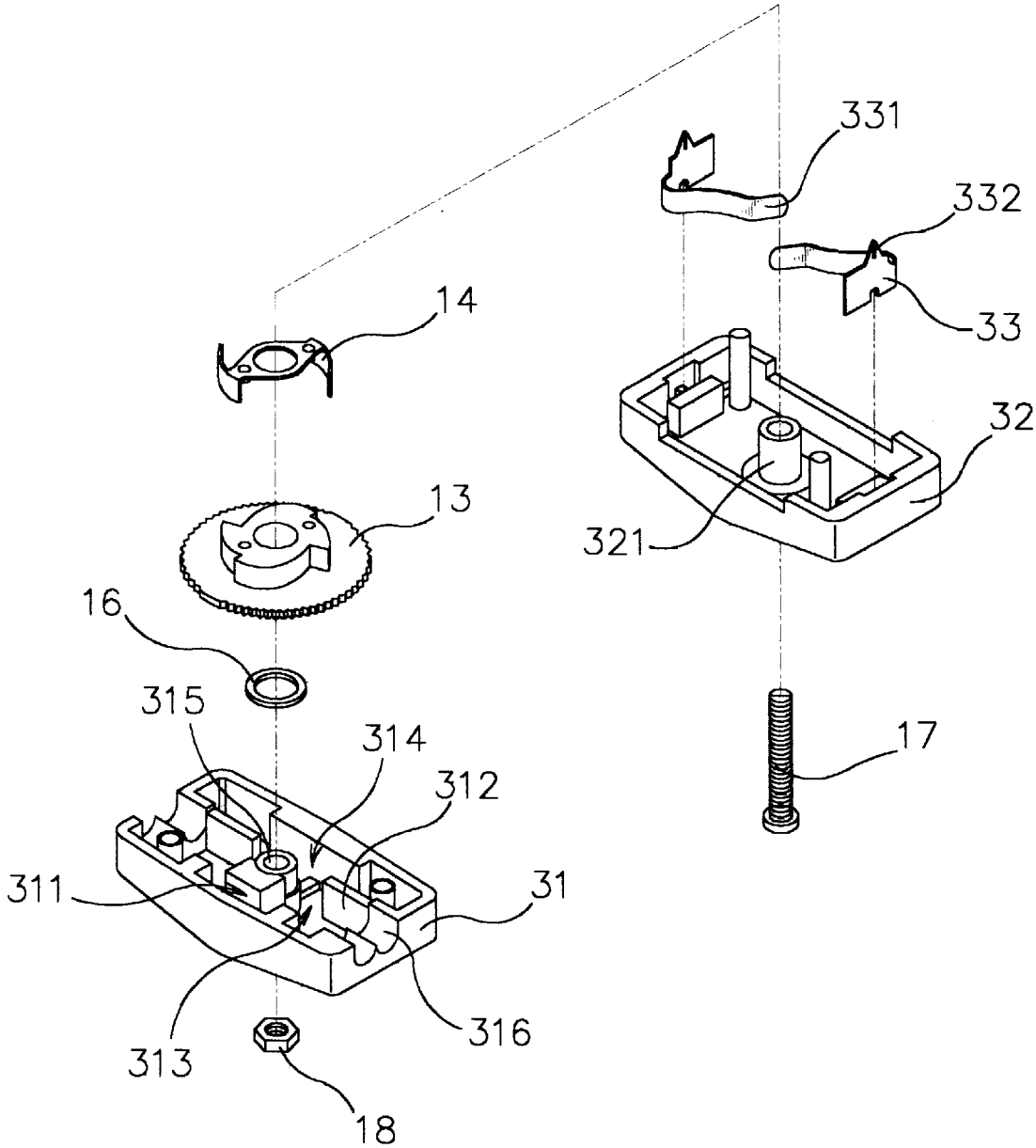
FIG. 2 is a schematic exploded view of the present invention.
Figure 3:
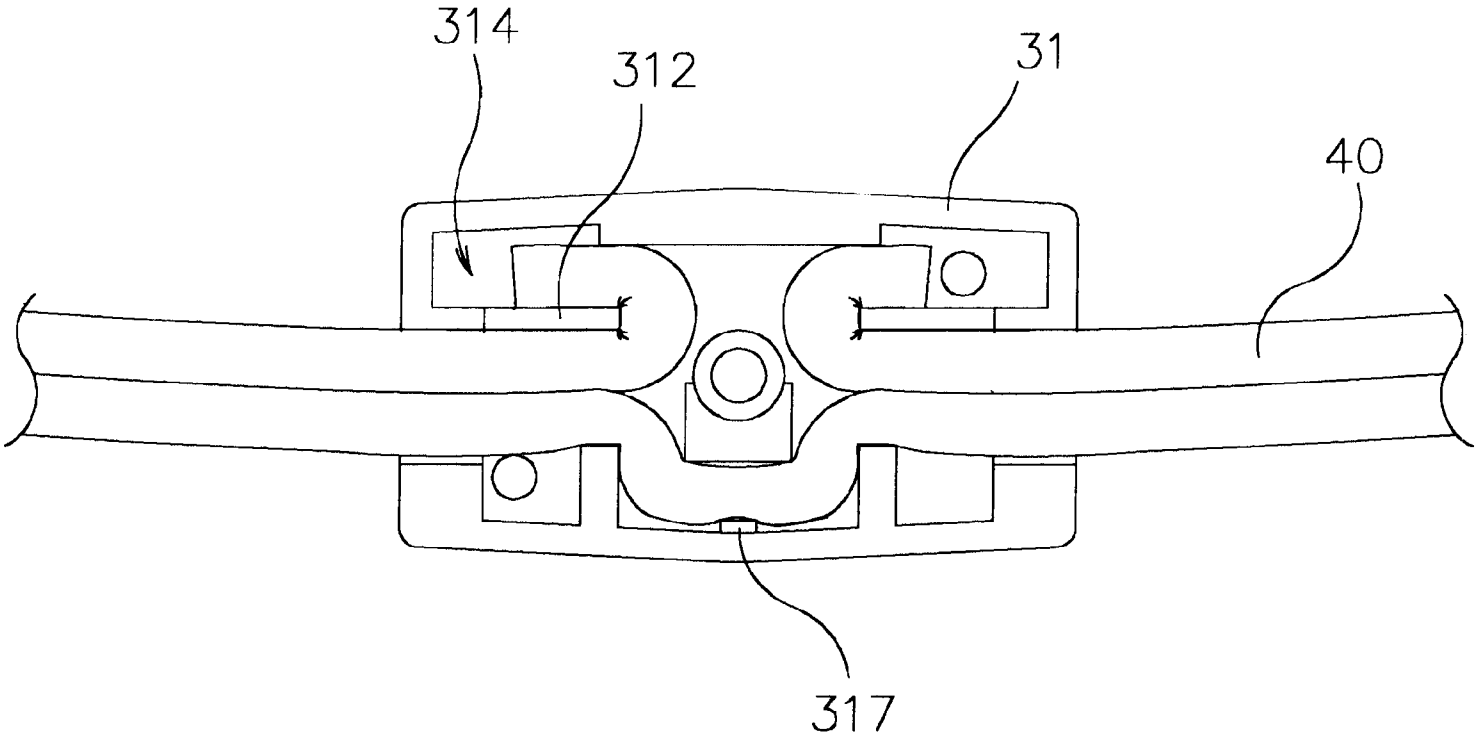
FIG. 3 is a schematic view of a power cord arrangement according to the present invention.

FIG. 2 is a schematic exploded view of the present invention and FIG. 3 is a schematic view of a power cord arrangement of the present invention. A lower housing 31, an upper housing 32, a switching wheel 13, a copper switching conductor 14, blade/leaf conductors 33, a washer l6, a screw 17 and a nut 18 are included. The lower housing 31 has at one of its internal sides a U shaped receptacle 311 with a protrusion 317 in it. When one of the cords of the power cable 40 is placed in the U shaped receptacle 311, it will be firmly held by the protrusion 317. Cord grooves 316 are provided on the outer edges of the lower housing 31 to allow the cords to pass, while preventing water from entering the house. At the other internal side a passage 313 is provided between two deflectors 312. Two ends of another one of the cords (which is sheared off the power cable 40) are placed in the receptacle 314 with each sheared cord portion of the power cable 40 being bent back around a positive deflector 312 by 180 degrees in order to firmly hold them in the receptacle 314 as shown in FIG. 3. Because the cord ends are firmly held in the receptacle 314 a secure and reliable electrical connection is obtained, thus eliminating the potential risk of electrical leakage or power failure due to the cord end removing and the blade 332 bending.

Figure 4:
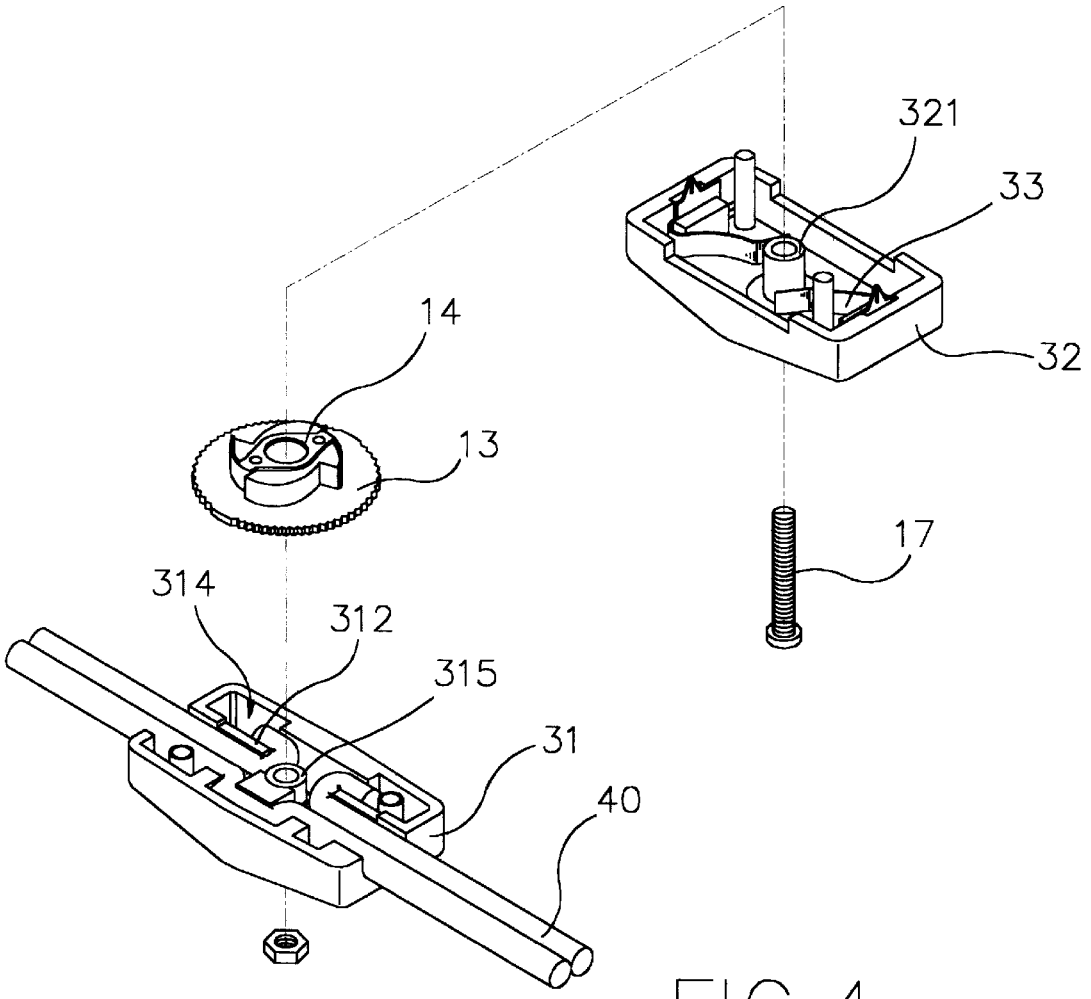
FIG. 4 is a schematic exploded view of the invention shown in FIG. 2, with a power cable arranged.
Figure 5B:
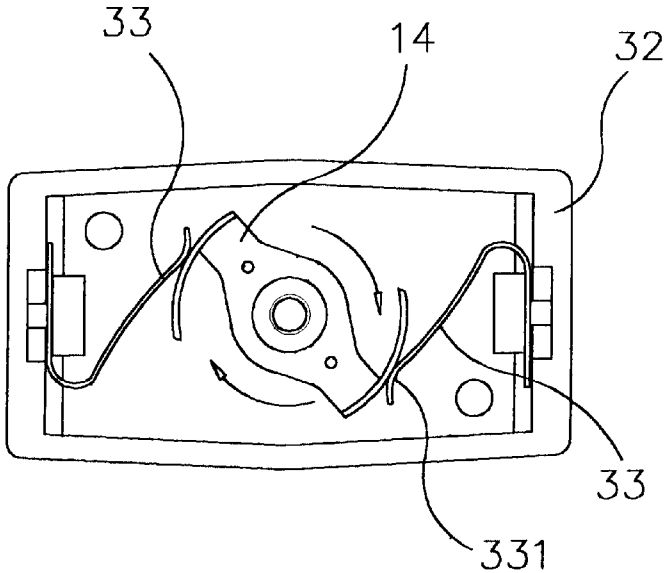
FIGS. 5A and 5B are schematic views of the present invention in operation.
Figure 5A:
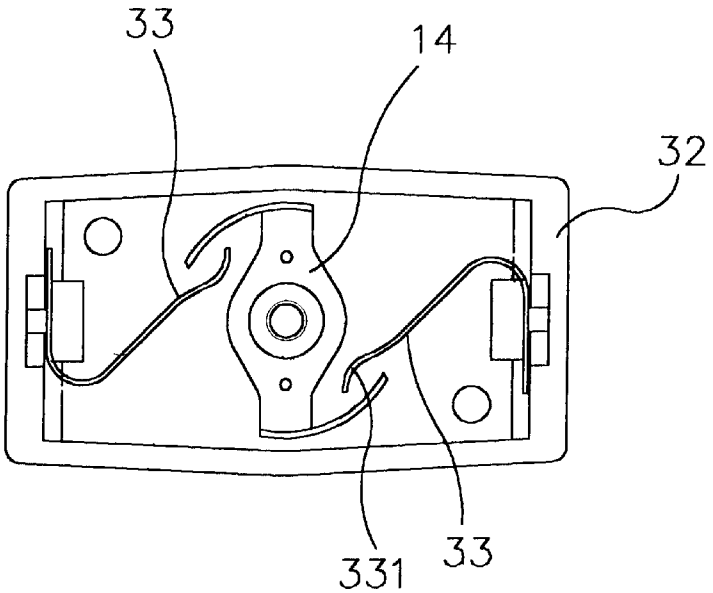

Then, the washer 16 is arranged over the lower housing 31. The switching wheel 13 with the copper switching conductor 14 are fit onto the pillow 321 in the upper housing 32. The blade/leaf conductors 33 are inserted in the upper housing 32, as shown in FIG. 4. Next, the upper housing 32 is assembled with the switching wheel 13 onto the lower housing 31. The upper and lower housing are pressed together so that the piercing points of the blade/leaf conductors 33 in the upper housing 32 cut through the outer cord insulator and contact with the inner conductive core wire, thus providing a function of electrical conduction. Finally, the assembly is fastened by a screw and a nut. It shall be noted that the blade/leaf conductors 33 have a convex end 331 and an elastic design so that when the upper housing 31 and the lower housing 32 are assembled together, the convex end 331 of the blade/leaf conductors will contact with the copper switching conductor 14, thus better presenting a 'plane to plane' contact, as shown in FIG. 5A and FIG. 5B. When the copper switching conductor 14 is turned due to the application of a foreign force, the convex end 331 of the blade/leaf conductor 33, because of the elastic design, will rest close against the copper switching conductor 14. The larger contacting area for electric conduction will avoid spark eruption, carbon and oxide production, and the leaf conductor breakage that causes a power failure.

The embodiment mentioned above is only a better example to embody the present invention, and does not restrict the range of embodiments of the present invention in any manner. Any modifications or changes made based on the present invention shall be considered to be within the scope of the present invention.

What is claimed is:

1. A switch for a power cable having at least two power cords, comprising:

an upper housing;

a lower housing connectable to said upper housing to define an interior space, said lower housing having opposing internal sides each for accommodating therein a respective power cord of a power cable, said lower housing further having a receptacle at one of the internal sides for receiving one of the power cords of the power cable, and having two opposing deflectors at the other internal side, said deflectors being spaced apart from each other to define a passage therebetween and each deflector being so disposed in said lower housing as to provide a space on each side of the respective deflector for accommodating the other one of the power cords, each of the spaces being in communication with the passage, wherein when the other one of the power cords is severed into two portions, each portion of the severed power cord is positioned to extend in the respective space on one side of the respective deflector and toward the passage, to bend back around the deflector, and to extend in the respective space on the other side of the deflector and away from the passage, so as to hold the respective severed portions of the power cord within the interior space;

a switching wheel rotatable about a central axis thereof, and disposed within the interior space;

a conductive switch conductor concentrically disposed on the switching wheel and rotatable therewith; and first and second blade/leaf conductors disposed within the interior space and adjacent to the conductive switch conductor, wherein when said conductive switch conductor is rotated, said conductive switch conductor electrically communicates said first and second blade/leaf conductors with each other, and wherein, as said conductive switch conductor is further rotated, said first and second blade/leaf conductors cease to be in electrical communication with each other, said first and second blade/leaf conductors each further having piercing points that extend toward the other internal side of said lower housing, said piercing points piercing the respective potions of the severed power cord when said lower housing is connected to said upper housing so as to be in electrical communication with the respective severed portions.

2. The switch recited in claim 1, wherein each of said blade/leaf conductors has an elongated, elastic portion having a convex end that presents a rounded apex that alternatingly engages and disengages with said conductive switch conductor when said conductive switch conductor is rotated.

3. The switch recited in claim 2, wherein said conductive switch conductor is rotatable 360 degrees around the axis of the switching wheel, and wherein as the conductive switch conductor is rotated through the 360 degrees, the respective rounded apexes of the blade leaf/conductors are electrically engaged with the conductive switch conductor two times, and electrically disengaged from the conductive switch conductor two times.

4. The switch recited in claim 1, wherein the receptacle in said lower housing is U-shaped, and wherein the one of the power cords of the power cable received in the receptacle is held therein in a corresponding U-shape.

5. The switch recited in claim 4, wherein said lower housing has a protrusion disposed at a base of the U-shaped receptacle, the protrusion pressing against the one of the power cords of the power cable received in the receptacle.

6. The switch recited in claim 5, wherein the U-shaped receptacle is defined by two parallel walls connected together by the base, the parallel walls extending essentially perpendicular to the base.

7. The switch recited in claim 1, wherein each portion of the severed power cord is bent back around the respective deflectors by about 180 degrees.

8. The switch recited in claim 1, wherein said lower housing further includes an outer edge, and two sets of two cord grooves formed in the outer edge, said cord grooves allowing the two power cords to pass into and out of the interior space, said cord grooves surrounding the respective power cords so as to prevent water from entering the interior space by way of the cord grooves.

* * * * *